US006856246B2

(12) United States Patent
Chicca

(10) Patent No.: US 6,856,246 B2
(45) Date of Patent: Feb. 15, 2005

(54) SYSTEM AND METHODS FOR AUTOMATED ALARM TRACKING AND BILLING

(75) Inventor: Edward Chicca, LaPlata, MD (US)

(73) Assignee: AOT Public Safety Corporation, Waldorf, MD (US)

( * ) Notice: Subject to any disclaimer, the term of this patent is extended or adjusted under 35 U.S.C. 154(b) by 289 days.

(21) Appl. No.: 10/153,864

(22) Filed: May 24, 2002

(65) Prior Publication Data

US 2002/0190857 A1 Dec. 19, 2002

Related U.S. Application Data

(60) Provisional application No. 60/292,951, filed on May 24, 2001.

(51) Int. Cl.[7] ..... G08B 29/00

(52) U.S. Cl. ..... 340/506; 340/507

(58) Field of Search ..... 340/507, 541, 340/531, 506, 539.14; 379/37, 42–44; 714/47; 700/79, 80

(56) References Cited

U.S. PATENT DOCUMENTS 5,689,235 A * 11/1997 Sugimoto et al. ..... 340/541
5,892,442 A * 4/1999 Ozery ..... 340/539.14
5,943,673 A 8/1999 Felouzis et al. ..... 707/104
6,060,994 A * 5/2000 Chen ..... 340/521
6,215,404 B1 * 4/2001 Morales ..... 340/577
6,281,790 B1 8/2001 Kimmel et al. ..... 340/506
6,400,265 B1 * 6/2002 Saylor et al. ..... 340/531
6,452,490 B1 * 9/2002 Garland et al. ..... 340/506
6,690,411 B2 * 2/2004 Naidoo et al. ..... 348/143
6,693,530 B1 * 2/2004 Dowens et al. ..... 340/506

* cited by examiner

*Primary Examiner*—Toan N. Pham
(74) *Attorney, Agent, or Firm*—Greenberg Traurig, LLP; Paul F. McQuade; James E. Goepel

(57) ABSTRACT

An automated alarm tracking system is provide which retrieves, collects, extracts, stores, analyzes, tracks, processes, and bills alarm data to provide a broad array benefits. In addition, the system provides numerous reporting and analytical tools to allow users to accurately identify false alarms, alarm patterns, geographically view alarm locations, and other information. The system enables users to define and modify various aspects and features to provide a customized automated alarm tracking system and methods.

10 Claims, 17 Drawing Sheets

SYSTEM AND METHODS FOR AUTOMATED ALARM TRACKING AND BILLING

This application claims the benefit of U.S. Provisional Patent application 60/292,951 filed on May 24, 2001, the entirety of which is incorporated herein by reference.

This application includes material which is subject to copyright protection. The copyright owner has no objection to the facsimile reproduction of this patent disclosure, as it appears in the Patent and Trademark Office files or records, but otherwise reserves all copyright rights whatsoever.

FIELD OF THE INVENTION

The present invention relates to a system and methods for automated alarm tracking and billing, in particular, the present invention relates to software applications for tracking, collecting, storing, analyzing, processing and billing alarm data.

BACKGROUND OF THE INVENTION

Local Law enforcement agencies expend thousands of hours each year responding to automated alarm calls. The vast majority of these alarm calls are false. The time and resources expended by Law Enforcement for these false alarm calls could be better utilized in other ways to reduce crime.

Further, many jurisdictions are enacting legislation which will allow them to monitor automated alarms and to charge the business and residential owners who fail to maintain and properly use their automated alarm systems thereby causing false alarms. This new legislation has resulted in the need for a sophisticated system to assist in the tracking and processing of alarms.

SUMMARY OF THE INVENTION

Accordingly, the present invention is directed to a system and methods for tracking and billing automated alarms which allows users to collect, track, store, process, analyze and bill alarm call information and data. Through use of the present invention users will be able to identify the location of false alarms, notify responsible parties, generate appropriate information for proper billing and documentation, analyze patterns, and make informed policy decisions for responding to alarms.

In a preferred embodiment, the present invention includes a software application for use by multiple parties and provides users a sophisticated system to assist in the tracking, processing and billing of alarms.

Additional features and advantages of the invention will be set forth in the description which follows, and in part will be apparent from the description, or may be learned by practice of the invention. The objectives and other advantages of the invention will be realized and attained by the structure particularly pointed out in the written description, as well as all drawings contained herein.

To achieve these and other advantages and in accordance with the purpose of the present invention, as embodied and broadly described, in one aspect of the present invention there is provided a system for tracking and billing alarms.

In another aspect of the present invention there is provided a system for processing and billing alarm data.

In another aspect of the present invention there is provided a method for retrieving and analyzing alarm data.

In another aspect of the present invention there is provided a system for tracking and processing alarm data comprising: at least one alarm company for receiving alarm signals from at least one alarmed facility; a dispatch system for receiving a plurality of alarm information from said at least one alarm company wherein said dispatch system enters said plurality of alarm information into at least one alarm record contained within an alarm data file; a processing system comprising a computer processing device for receiving said alarm data file, a database for storing a plurality of stored alarm data, and a software application for processing each of said at least one alarm record against said plurality of stored alarm data and at least one predefined criteria. The processing system may be located in a remote facility from the dispatch system. The remote facility may be an outsource agency or a remote police facility located within the jurisdiction.

In another aspect of the present invention there is provided a method for tracking and processing false alarms comprising the steps of: establishing a set of pre-defined criteria; obtaining an alarm data file comprised of at least one alarm record, wherein said at least one alarm record contains a plurality of alarm data including an associated record identifier; processing each one of said at least one alarm record against a plurality of stored alarm data; combining data from said at least one alarm record to related data within said plurality of stored alarm data to create a combined alarm data record; comparing said combined alarm data record against said set of predefined criteria to determine if any data of said combined alarm data record has met or exceeded at least one of said set of predefined criteria; and creating an appropriate correspondence for said record identifier associated with said at least one alarm data record which has exceeded at least one of said set of predefined criteria. The correspondence may be an invoice or letter. In addition, the record identifier may be the name of the alarm registrant associated with said alarm record or the location of an alarmed facility associated with the alarm record. The method of the present invention may also determine if the alarm record is related to a new registrant or location and if so create a new registrant or location entry within the plurality of stored alarm data.

In another aspect of the present invention there is provided a programmable software application for tracking and processing false alarms which performs the following processing steps: establishes a set of pre-defined criteria; obtains an alarm data file comprised of at least one alarm record, wherein said at least one alarm record contains a plurality of alarm data including an associated record identifier; processes each one of said at least one alarm record against a plurality of stored alarm data; combines data from said at least one alarm record to related data within said plurality of stored alarm data to create a combined alarm data record; compares said combined alarm data record against said set of predefined criteria to determine if any data of said combined alarm data record has met or exceeded at least one of said set of predefined criteria; and creates an appropriate correspondence to send to said record identifier associated with said at least one alarm data record which has exceeded at least one of said set of predefined criteria. The correspondence may be an invoice or letter. The record identifier may be an alarm registrant or location. In addition, software application performs the process of determining if the alarm record is related to a new registrant or new location and if so creates a new registrant or new location entry within the plurality of stored alarm data.

DETAILED DESCRIPTION OF THE PREFERRED EMBODIMENT

Figure 1:
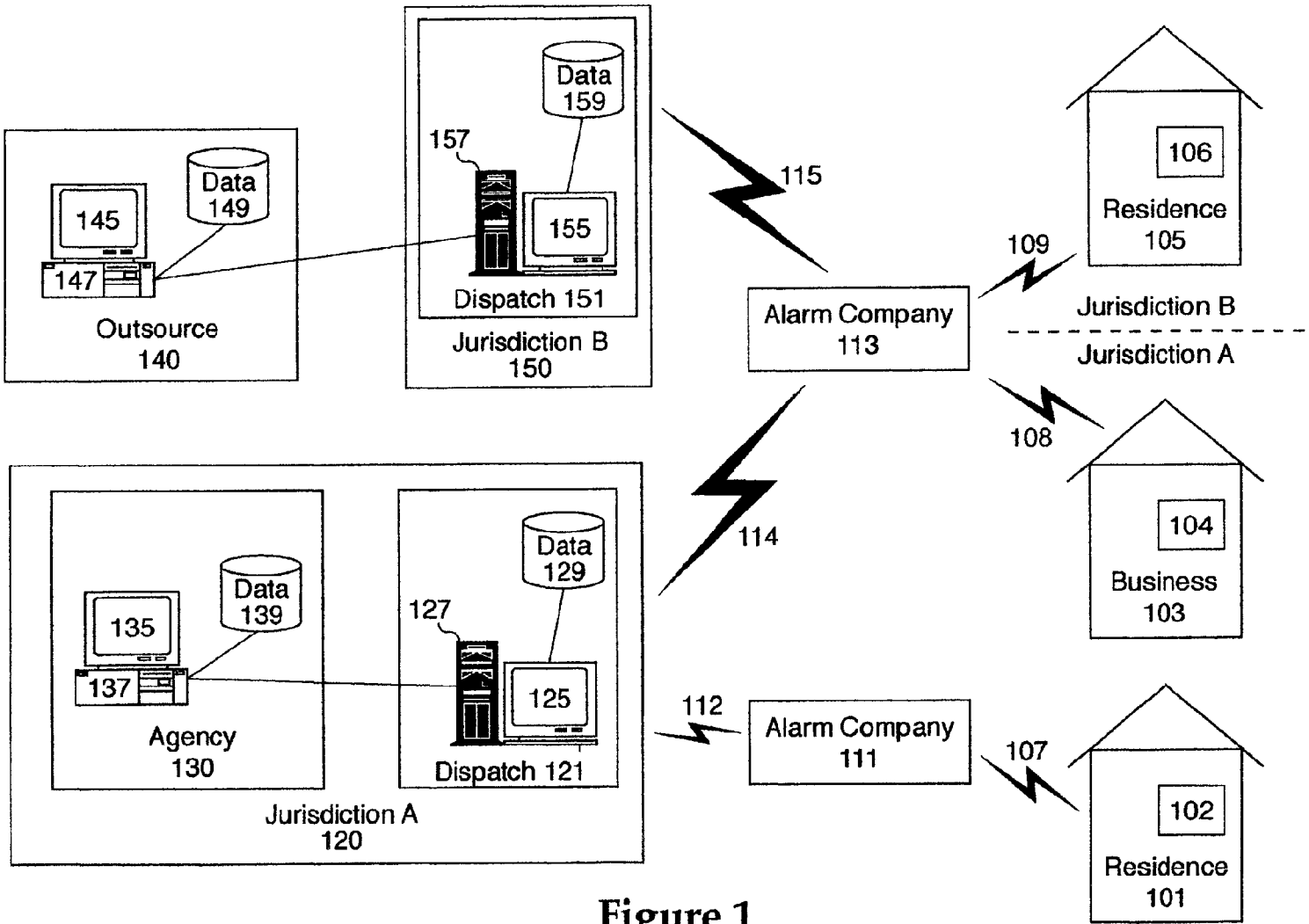
FIG. 1 is a schematic diagram of the network system of the preferred embodiment of the present invention.

The present invention is directed to a system and methods for tracking and billing alarms which allows users to collect, track, store, process, analyze and bill alarm call information and data. The present invention will allow users to identify the location of false alarms, notify responsible parties, generate appropriate information for proper billing and documentation, analyze patterns, and make informed policy decisions for responding to alarms.

The system of the present invention also receives and stores alarm call data and analyzes and processes the data to provide users with a sophisticated system for interacting with alarm data and alarm system users. Alarm calls can be automatically entered from any Computer Aided Dispatch (CAD) system capable of generating a simple ASCII file. In addition, alarms can be reviewed through Geographic Information System ("GIS") technology such as the one produced by Environmental Systems Research Institute ("ESRI"). The system allows an unlimited number of alarmed locations, both business and residential, can be entered into the system. Multiple persons can be stored for each location registered, allowing for the tracking of Owners, Responsible Persons, Responding Persons, and other information In addition, information can be stored on the Alarm Companies that sell, service or monitor the alarm systems. Multiple responsible persons can be entered for each Alarm Company.

The present invention allows payment information to be entered and tracked by Registration Number, Name, Alarm Company, Location, Invoice and other data. Related Invoices can be reviewed status; outstanding, paid, all invoices, or by specific invoice number. Full account history can be reviewed at any time. Data from the alarms can not only be used to identify problems in alarm systems, such as excessive false alarms, but can also be used to populate notices, warnings, invoices, and account histories. The present invention provides the user with a system which can collect, analyze, and process alarm data to provide an accurate tool for minimizing false alarms as well as increase the efficiency of jurisdictions or customers and time spent dealing with alarms.

The system may include special Maintenance screens which allow for important customization. The system may include special user interfaces which allow the users various options such as an option as to whether false alarms should be billed with an "Automatic Charge/No-Charge" and an option which also allows for comments. In addition, the system allows the user to define parameters and definitions for when options are applied as well as rules regarding those options such as defining specific fines for each alarm count. The user can also create and save multiple file input formats.

Another feature of the present invention is the graphical mapping tool, which can be incorporated to allow users to view alarms through mapping tools, allowing for the visual interpretation of alarm patterns. The present invention also enables statistical and graphical alarm information to be viewed, printed directly, or copied into a word processor. Additional features of the present invention include easy user-customization, windows-based technology, the ability to map alarm call and registration information, GIS oriented systems, and the ability to process multiple alarm input file formats.

The present invention can also analyze data and produce various reports associated with the analysis including: Aging Report, Invalid Geo-Code Report, Activities by Date Range, Alarms by Date Range, Alarm Statistics by Date Range, Dispatch Statistics by Date Range, Registration by Date Range, Registration Statistics by Date Range, Top Offenders Report, Count Registrations by Alarm Company, List Registrations by Alarm Company, False Alarm Statistics by Alarm Company, Registration History Report, Review Appeal Hearings by Registration, Print Mailing Labels.

The tracking and processing of alarm data includes entry of licensed alarm holders, tracking of each alarm that occurs by location, accessing dispatch and the Records Management Systems ("RMS"), reviewing alarm locations through geospatial data, inputting an unlimited number of alarmed locations, and multiple persons to be stored for each location. The alarms can be viewed via mapping tools, allowing for the visual interpretation of alarm patterns in addition to statistical and graphical alarm information.

The alarm tracking system of the present invention, as seen in FIG. 1, provides a way for tracking and billing alarm data for residences, businesses, or any facility or building with an installed alarm system. The residences or businesses 101, 103, 105, each contain an alarm system 102, 104, 106. As indicated in FIG. 1, the residences or business 101, 103, 105 can be located in separate jurisdictions. The alarm systems 102, 104, 106 are each connected or communicating with an alarm company 111, 113. Most alarm systems are wired into the phone line or system of the given residence or business 101, 103, 105. The alarm companies 111, 113 receive the alarm signal 107, 108, 109 from the alarm systems 102, 104, 106 and electronically communicate with the appropriate Dispatch 121, 151 for the corresponding jurisdiction 120, 150 in which the residence or business 101, 103, 105 is located. The alarm companies 111, 113 typically telephonically call, as indicated by signals 112, 114, 115, the appropriate Dispatch 121, 151 for the appropriate jurisdiction 120, 150. However, the communication signals 107, 108, 109 from the alarms systems 102, 104, 106 to the alarm companies 111, 113 and the communication signals 112, 114, 115 from the alarm companies 111, 113 to the appropriate Dispatch 121, 151 may be by any form of electronic communication including internet, voice, e-mail, or any other communication technology appropriate for the urgency of the alarm. The Dispatch 121, 151 in most instances is the emergency call center which receives all police and emergency calls, such as those placed to 911, for a given jurisdiction 120, 150.

As alarm signals 107, 108, 109 from the residences or business 101, 103, 105 have been processed and relayed from the alarm companies 111, 113 to the appropriate Dispatch 121, 151 the alarm data is entered into the dispatch computer 125, 155. Information about the alarm is relayed to police officers for appropriate response and the data from the alarm is stored or saved in a data file 129, 159.

As indicated in the configuration depicted in Jurisdiction A 120, the Dispatch 121 may be the dispatch for both police, fire, and ambulatory rescue operations. The police agency 130 of Jurisdiction A 120 may utilize the system of the present invention in their off-site facility using a separate computer 135. The agency 130 computer 135 has a connected database 139 and the relevant software or computer code 137 resident on the computer 135 which enables the alarm tracking system of the present invention. The agency 130 will retrieve or be sent a data file from the Dispatch computer 125 which contains all of the alarm records for a given time period, typically daily, and process the data, as will be described in more detail below.

Another configuration of the present invention, as seen in relation to Jurisdiction B 150 would have the relevant software or computer code 157 resident on the computer 155 of the Dispatch 151. Once again the computer 155 would have a connected database 159 for storing system data such as alarm records, registrant information and other data. In the Jurisdiction B 150 configuration the data file resident on database 159 containing all of the alarm records for a given time period is then processed by computer 155, as will be described in more detail below.

Another still further option or configuration of the system would include an outsourcing agency or facility 140. In the outsourcing configuration, the outsource agency 140 would have a computer 147 which has a connected database 149 and the relevant software or computer code 147 resident on the computer 145 which enables the alarm tracking system of the present invention. The outsourcing agency 140 will retrieve or be sent a data file from the dispatch 151 computer 155 which contains all of the alarm records for a given time period, typically daily. The outsourcing agency 140 will then process the alarm data, as will be described in more detail below.

Although the configurations described above describe a system in which alarm data is stored for a given time period and then processed by the software application of the present invention the system can also receive or retrieve alarm data as it is entered into the system at the dispatch and process the alarm data immediately.

Figure 2:
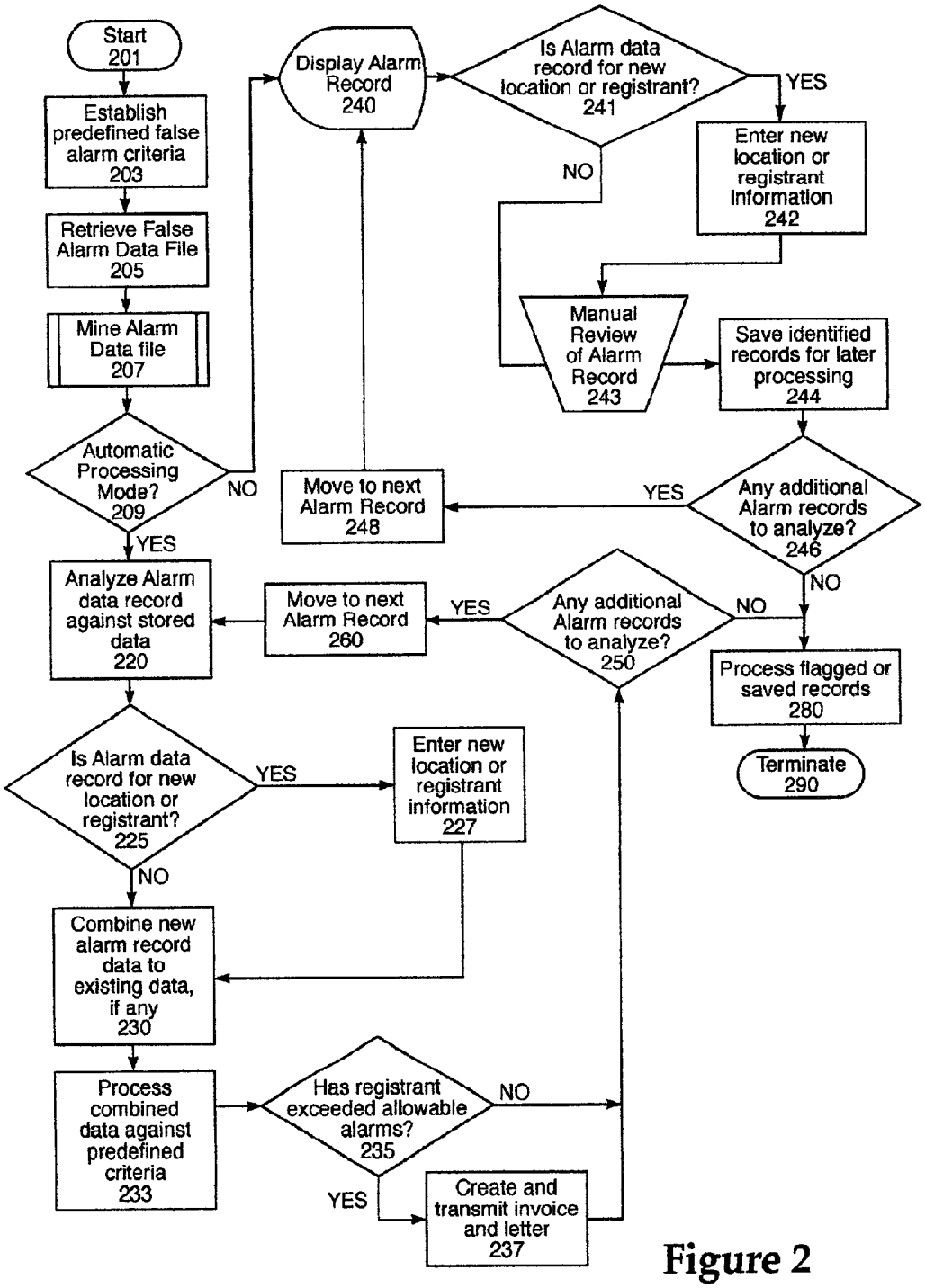
FIG. 2 is a flow diagram of the data processes performed by the software application of the preferred embodiment of the present invention.

The method and system of the present invention and how it processes the alarm data will be described in conjunction with FIG. 2. The process is started in step 201 where the User initiates the computer program or software application resident or running on a computer processing device in a given location such as a law enforcement agency. After starting the process, the User establishes some predefined criteria in step 203. The establishment of predefined criteria will be described in more detail below but would generally consist of defining the number of false alarms allowed, the amount of fines and penalties, and whether the data file will be processed manually or automatically. The alarm data information for a given time period, such as a day, is stored in a data file which may be located at the dispatch 121, 151. The agency 130 or outsourcing agency 140 retrieves or receives the alarm data file from the dispatch 121, 151 as seen in step 205. The alarm data file is mined and processed in step 207 where the type of alarm, location, classification, comments and any other information related to each alarm record is compared to stored data on registered alarm locations.

In step 209 the system determines if the user has selected the data to be processed automatically or manually. If the User has selected Manual review the alarm record is displayed in step 240. In step 241 the User or system may determine if the alarm data record is for a new location or registrant. If the alarm is for a new location or registrant the new information is entered in step 242. If the alarm data is not for a new location of registrant or once the new information has been entered (see step 242) the User manually reviews the alarm record in step 243. The User may save identified alarm records which need additional processing in step 244. By saving or flagging identified alarm records the user can review all of the records in a timely fashion and place the alarm records into an appropriate category, file, or folder which allows the User to create invoices or correspondence to a selected group of alarm record responsible parties.

After the User has reviewed the alarm record and determined if the record needs to be saved or flagged the User can move to the next record. The system determines if there are additional records in step 246. Provided there are additional alarm records the system retrieves the data for the next record in step 248. The new record is now displayed in step 240 and the process is repeated until all of the alarm records for a given data file have been processed.

When the system determines that there are no additional records to process, in step 246, the User can process the saved records in step 280. This processing, as described above and as will be described in more detail below, provides the User the ability to invoice, send correspondence, add, delete, or edit information in the system as well as a whole host of other capabilities. Once the User has completed the data processing the session is terminated in step 290.

If the User has selected to have the data file processed automatically, see step 209, the data for a given alarm record is analyzed against the stored data in the system. The stored data in the system contains data from previous alarms as well as information entered by the User or loaded from other sources including information on alarm companies, alarm registrants, mapping information, as well as a host of information related to the jurisdiction. In step 220, the alarm record is analyzed against the stored data within the system. The system can determine if the data for the alarm record represents a new registrant not previously entered into the system as seen in step 225. If the alarm record is for a new location or registrant the information is entered as a new data record in the system in step 227 and the record is flagged, placed in a folder, or stored in a file for later review and input by the User. The system then combines the alarm record with any existing data, if any, for the registrant or location in step 230.

If the system determines, in step 225, that the alarm record is not for a new location or registrant the data from the alarm record is added to the existing data stored in the system, as seen in step 230. In step 233, the combined data is processed against the predefined criteria established in step 203. The system, in step 235, determines if the registrant or location has exceeded any of the predefined limits. If so, the system flags the record, places it in a folder, or saves it in a file for later processing by the User or the system, as seen in step 237, can automatically create invoices and correspondence, print copies of such invoices and correspondence, or electronically transmit the invoice and correspondence to the registrant.

After the system has either entered new registrant or location information in step 227, determined that the registrant has not exceed the predefined limits in step 235, or has created an invoice in step 237 the system determines if there are additional alarm records to review, as seen in step 250. If there are additional alarm records to review the system retrieves the next record, as seen in step 260, and analyzes the alarm record against the stored data of the system, as seen in step 220.

When the system determines that there are no additional records to process, see step 250, the User can review and process any saved records in step 280. The User has the ability to invoice, send correspondence, add, delete, or edit information in the system as well as other capabilities as will be described in more detail below. Once the User has completed the data processing the session is terminated in step 290.

The preferred embodiment of the present invention will be described in more detail in conjunction with FIGS. 3–16. The preferred embodiment provides an alarm tracking system which includes an automated user friendly computer system specifically designed to track alarm calls within a particular jurisdiction. This system gives the users the capability of processing alarms, both true and false. The system stores and tracks alarms by alarm locations. The preferred embodiment of the system allows users to register or enter information on alarm companies, alarm vacations as well as a responsible party or a registrant.

Figure 3:
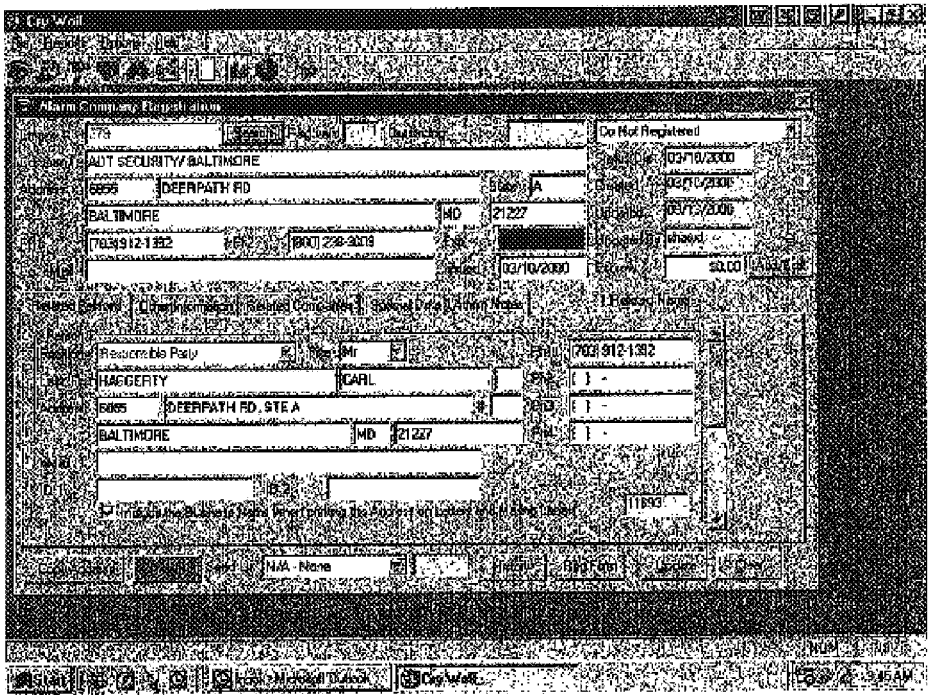
FIG. 3 is a screen capture of the Alarm Company Registration component of the preferred embodiment of the present invention.

As seen in FIGS. 3–16, the preferred embodiment incorporates a software application or computer program which provides user friendly menus and screens for entering, displaying, or controlling the data related to the alarm. FIG. 3 represents the alarm company registration screen of the preferred embodiment. The system allows for the input of the alarm registration because although alarms are primarily tracked by the address where the alarm is generated it is often important to track the alarm company that installed and monitors the alarm. The user is able to store useful information and data related to the alarm companies and is able to customize the menu by adding or deleting various fields for the alarm company.

Figure 4:
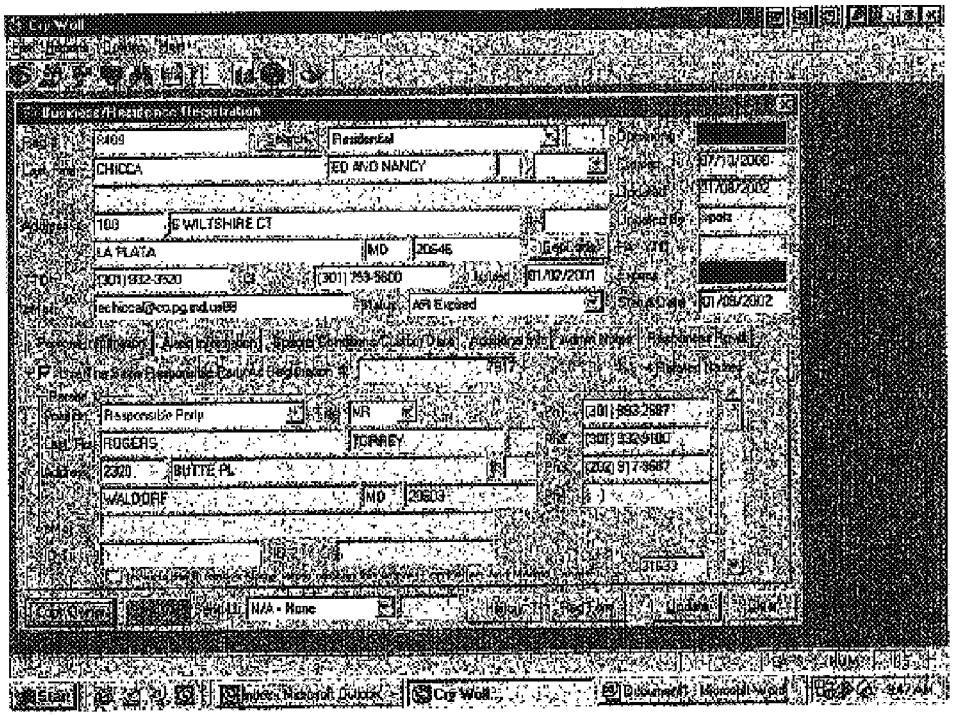
FIG. 4 is a screen capture of the Business/Residence registration component of the preferred embodiment of the present invention.

FIG. 4 represents a screen for entering business or residence registration information. The screen allows the user to input all relevant contact information and location of the business or residence including the personal information, alarm information, special conditions or custom data, and any additional information or notes. This list of alarm companies can always be added to or edited and the system can be used to create and establish the letters, invoices or other correspondence needed to use in conjunction with the billing and notification functions. The system also allows the User to establish all sorts of letters, customize the letterhead, invoices, and reports.

Another aspect of the system is the ability to store and track alarms by alarmed locations or facilities, and therefore each alarmed location should be registered. As seen in FIG. 4, the preferred embodiment includes a user friendly screen which allows the user to input and save data on registered alarm locations. Information already in the system can be used to populate known data. The alarm license or Business/Registration screen may include the occupant's name, address, email address, and phone numbers, as well as registration type, fees paid (if any), status date, date paid, expiration date and check number if applicable. Related personal information on the resident or responsible party can be entered. The system will check every time the User enters a new address to see if that address already exists in the program. If the address is found, the User is shown a list of matches for review. The User may link the alarm licensee or registrant to the alarm company and set information on the type of alarm, as well as special fee and fee waiver information. The registration screen allows the User to enter such information as whether the alarm is audible, the date installed and/or inspected and the alarm company monitoring the alarm. The User may also enter miscellaneous information, special conditions, additional information and administrative notes.

Another feature of the preferred embodiment enables the registration fee to be based upon the location type. The User can choose a status for each type of location and set a related fine/charge. For example, the User may set a charge of $100.00 for a status of Not Registered. But if the User chooses this status for a new registration, the fee shown and recorded will only be the registration fee related to the location type, such as Residential or Business. This allows the User to customize and specify any registration fees, fines and any other costs or rules based upon a User defined criteria such as residence or business, which jurisdiction, escalating fines for repeat false alarms and so forth.

The preferred embodiment has the ability to process alarm files and is capable of reading a fixed length or tab delimited text file generated by the User's dispatch system, matching it against those locations currently registered, determining the alarm count, and the appropriate charge. The system or User can determine the time frame for alarm charges. Depending upon the jurisdiction, alarm charges can be based on a floating number of months (i.e., base charges for all alarms that occurred in the past 12 months from the date of this alarm) or based on a given date each year (base charges on all alarms that have occurred since June, 1) or any set of defined parameters.

Figure 5:
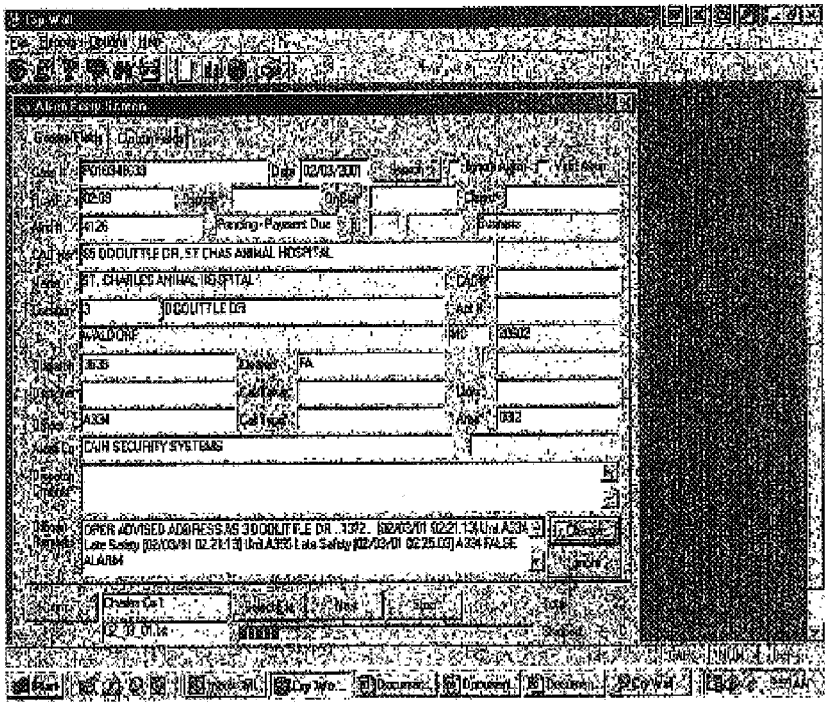
FIG. 5 is a screen capture of the Alarm Entry component of the preferred embodiment of the present invention.
Figure 6:
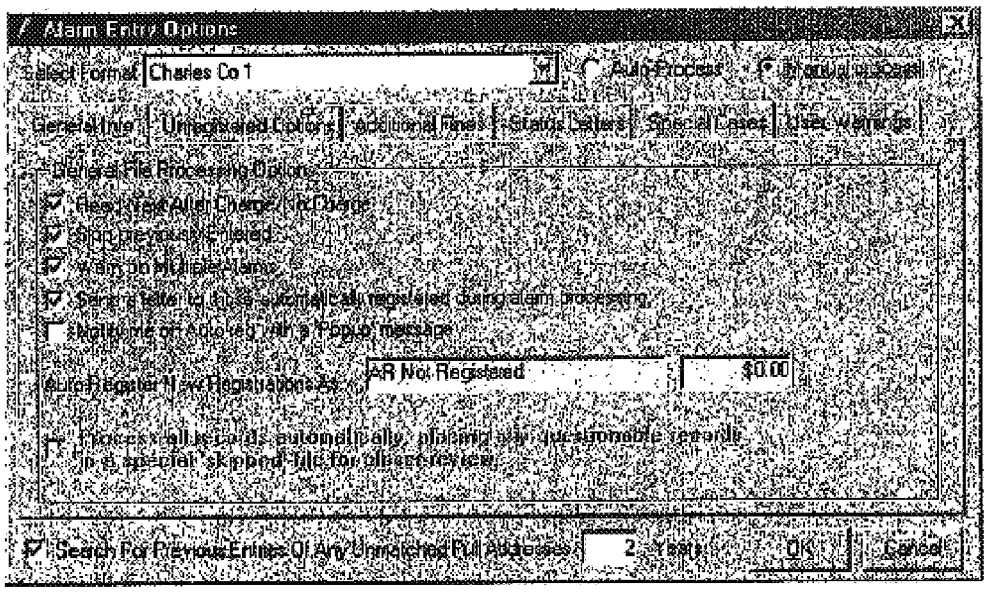
FIG. 6 is a screen capture of the Alarm Entry Options component of the preferred embodiment of the present invention.

As seen in FIGS. 5 and 6, the User may use the Alarm Entry screen to define the alarm file format. After the User defines the file format, processing alarms is simple. False Alarm Entry Options are selected by clicking the Options button on the lower left of the screen. There are several options for processing False Alarms. As seen in FIG. 6 the two buttons at the top right hand side allow the User to use the Auto Process or Manual Process. The system may also utilize an interactive mode of processing the alarm files where if a decision needs to be made the program stops and the User will be given options, such as Charge or Ignore. The Manual mode presents one alarm at a time on the screen. The User can make the decision for each alarm, Charge, Ignore, or the User might even be asked to verify the address or name for a particular location. All three options are valid depending upon the needs for the User's jurisdiction.

In the preferred embodiment the User locates and selects the file or files the User wish to process. These files may be produced by the User's 911 Computer Aided Dispatch ("CAD") programs. They are generally batch processed once a day at an off-peak time. A small message should appear advising that there are a certain number of alarms for processing in this file. The User will notice that the system has confirmed the License # for a given location and determine if this is the first alarm for this address during this time period.

In the Manual mode, the User may press either the Charge or Ignore button depending on how the User wishes to process this alarm. Since nothing indicates this is a false alarm, the User would probably press Ignore. The screen automatically moves to the next record and all the User needs to do is look at the information presented on the screen for each record, and press the Charge or Ignore buttons. The User can continue to process the files manually in this fashion, or the User can use the automatic processing feature to speed things up.

Most CAD systems will track officer comments, dispatch type, and clearance for all calls for service. The system also allows the User to predefine actions (Charge, Ignore) based on clearance types and officer comments. Once these options are set, each file can be processed based on those parameters.

To test out the semi-automated system, click on the Options button and select the Auto-Process button. Alarm files can be processed in either manual or auto process mode. In both processing modes, the alarm records are loaded automatically onto the screen. The difference is that in the automatic mode the program can be set to determine whether to charge or ignore an alarm based on officer clearance or comment information. There may be cases where even in automatic mode, the User would like a chance to review a specific record. One option in the maintenance program is an auto-stop feature for any officer clearance or comments. When the program processes a record which is marked as auto-stop, a special screen loads with pertinent information displayed on the screen. The User is given the opportunity to review the information to determine whether to process the case normally, mark it as ignored, or skip the record completely. When the User press the Next button, each record will be automatically Charged or Ignored, based on pre-established criteria, and the system will move to the next record. The processing will continue uninterrupted until it hits duplicate or unknown addresses. After the last record is processed, the User will see a notice that all records have been processed at this time. If the User had skipped any records for whatever reason, the User will also be presented with a message box advising that records had been skipped and asking the User if the User would like to save these specific records to a new file. The User can then review these records in a word processor such as Word or WordPerfect.

Figure 7:
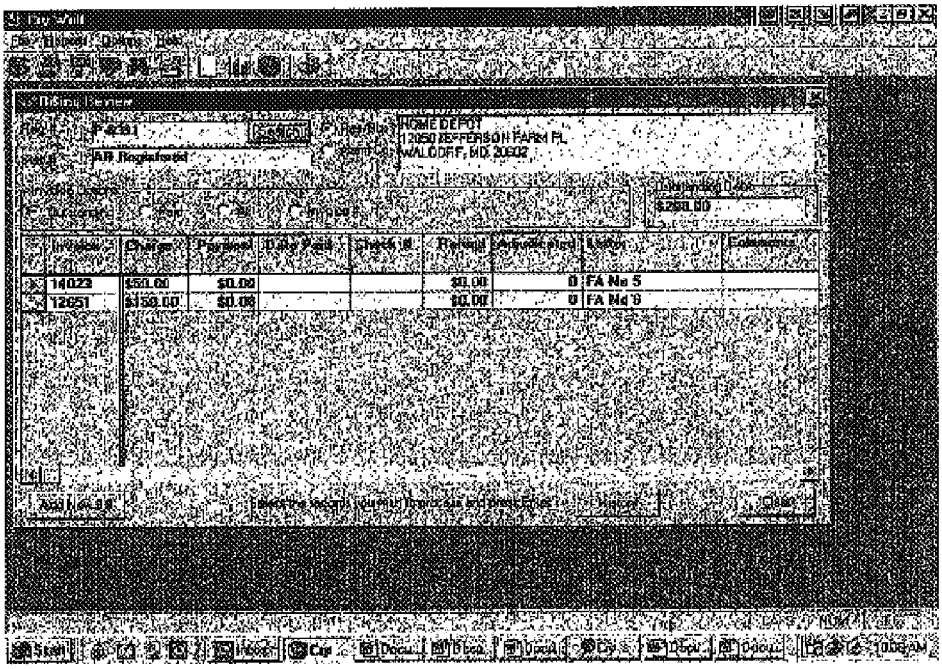
FIG. 7 is a screen capture of the Billing Review component of the preferred embodiment of the present invention.
Figure 8:
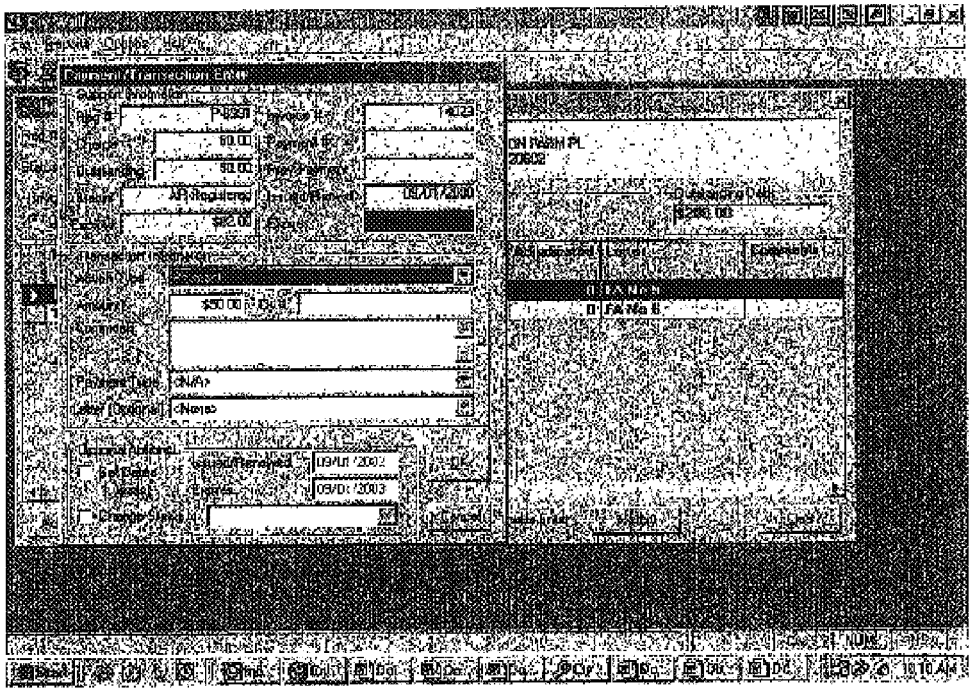
FIG. 8 is a screen capture of the Payment or Transaction entry component of the preferred embodiment of the present invention.

The system is particularly useful for jurisdictions with established legislation for False Alarms with developed charging structures based on the number of alarms received. Therefore, many of the system-generated correspondence involves billing alarm licensees for false alarms. The payment entry screen, as seen in FIGS. 7 and 8 allows the User to record the payments made by each licensee. The User can record a payment of a single invoice or multiple invoices at one time. Multiple actions can be placed against a single invoice bill, such as a payment, returned check, incorrect payment entry or the like.

In addition, almost every action performed in the system can result in some form of letter being generated for sending to the registrant or alarm company involved. A copy of this correspondence is automatically stored for later retrieval.

Figure 9:
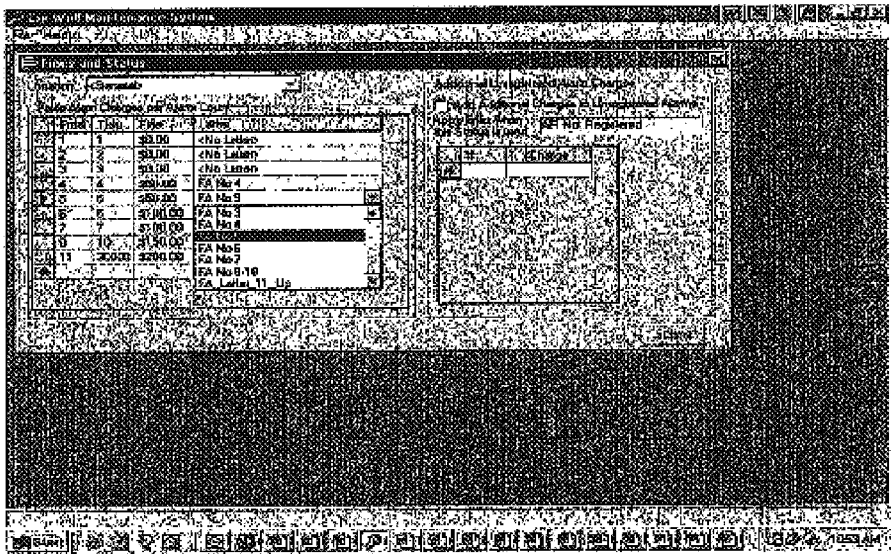
FIG. 9 is a screen capture of the Fines and Status component of the preferred embodiment of the present invention.

In the processing of false alarm calls, the normal procedure is to process each day of alarms and then to mail the cover letter and any associated invoice (bill) to the registrant. However, the User's jurisdiction may prefer to send out monthly, or some other Periodic time interval, statements for false alarm charges. Larger jurisdictions may prefer this approach to reduce overall mailing costs. The preferred embodiment has been designed to allow the User to choose either approach, a Periodic invoice or separate invoices for each alarm or can use both approaches. For example, the User may wish to send a letter to the registrant for the first alarm call that explains the problem, but starting from the second alarm send a monthly invoice only. As seen in FIG. 9, the preferred embodiment includes a Fines and Status menu where the User can enter the range of alarm counts and choose the letter the User wishes to send to each count or range of counts.

Figure 10:
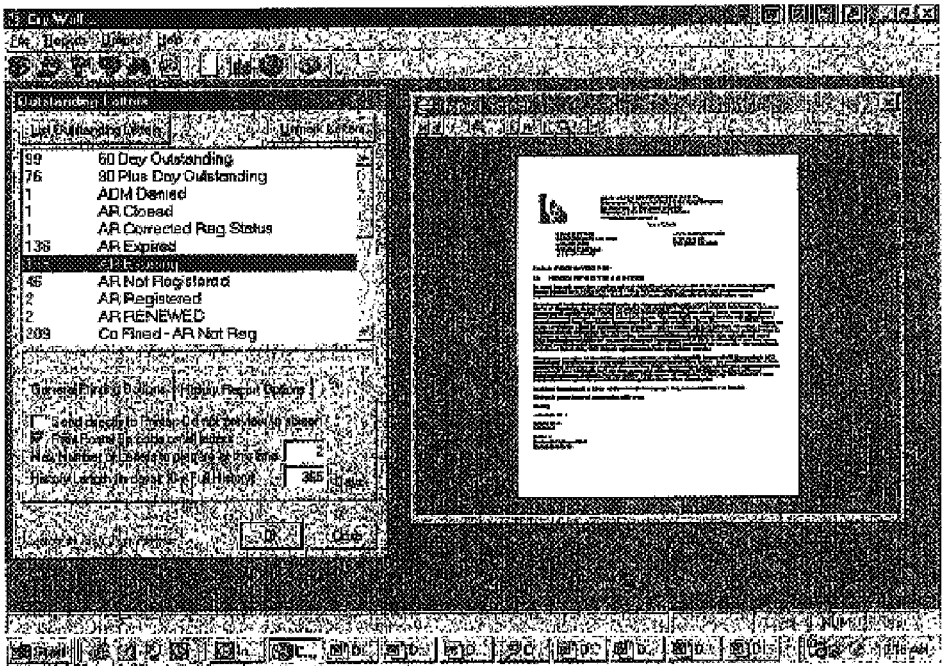
FIG. 10 is a screen capture of the Outstanding Letters component of the preferred embodiment of the present invention.

Creating and transmitting correspondence to the registrant, location or Alarm Company is another feature of the alarm tracking system. As seen in FIG. 10, the preferred embodiment provides a list of form letters, a way to create new letters and documents, and a way to track letters that have not been generated ensuring that critical correspondence is never overlooked. When the User select a letter(s) to be previewed to the screen, the Invoice Number is tracked internally. If the letter is acceptable to the User, and the User send the letter(s) to the printer, a message box will pop up on the screen providing the User the opportunity to mark the letter as completed. The User has the option of saving every letter in a, as a word, ASCII, or PDF file format, all of which can be electronically transmitted to the registrant of Alarm Company. The system is also able to track expiring and expired registrations, generate and send out bulk letters, and create mailing labels.

Figure 11:
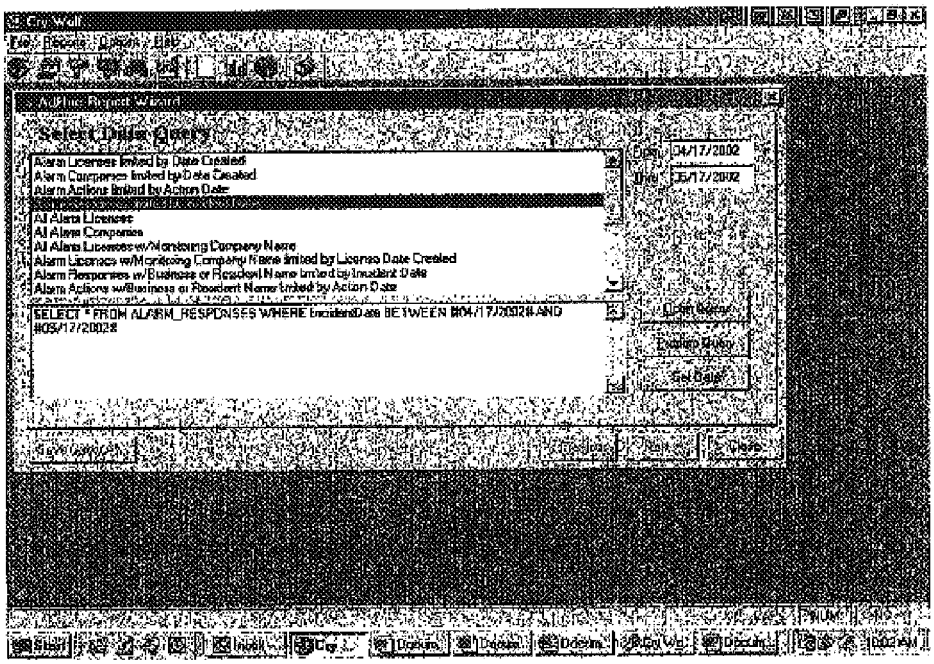
FIG. 11 is a screen capture of the report generator component of the preferred embodiment of the present invention.

The preferred embodiment also includes a report generator application using a selected data query as seen in FIG. 11. The User selects records and fields and the format of the report. The User can select a query from the list, either as a starting point or as the final query, or click the Open Query button to view previously saved queries. The User can also edit or create new queries.

Figure 12:
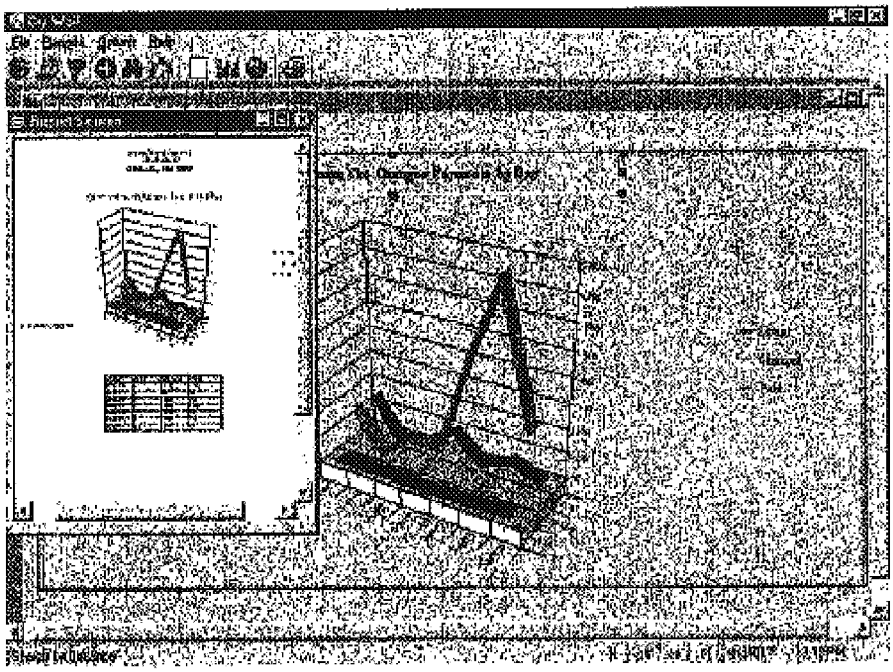
FIG. 12 is a screen capture of the Alarm Graphing component of the preferred embodiment of the present invention.

The preferred embodiment is capable of generating various charts and graphs based on alarm information, as seen in FIG. 12. The User can graph such things as alarm calls and letters sent. The graphing can be grouped many different ways including: by minute, minute intervals, hours, Day, Quarter, Week of Year, Month of Year, or Day of Week. Graphs can be limited by a date range and can also be limited by any location type used during registration (i.e. only chart Businesses, or only chart Residences).

Figure 13:
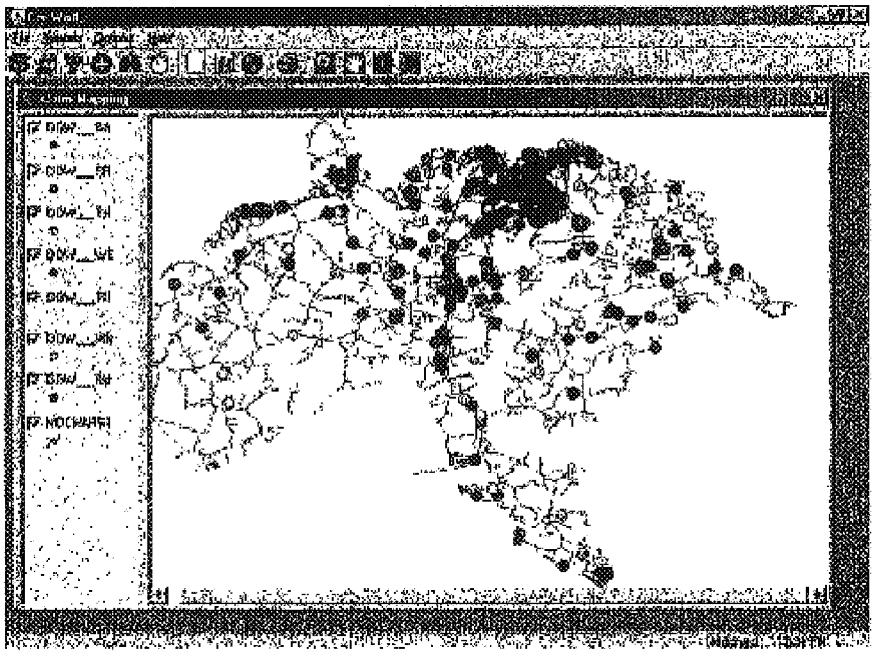
FIG. 13 is a screen capture of the Alarm Mapping component of the preferred embodiment of the present invention.
Figure 14:
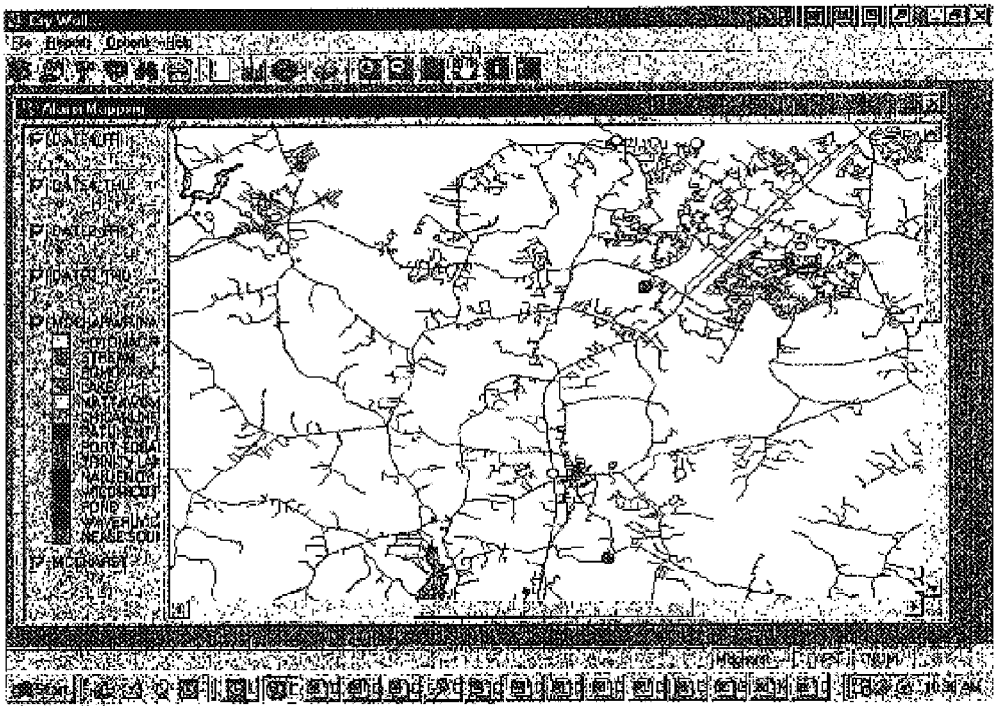
FIG. 14 is an additional screen capture of the Alarm Mapping component of the preferred embodiment of the present invention.
Figure 15:
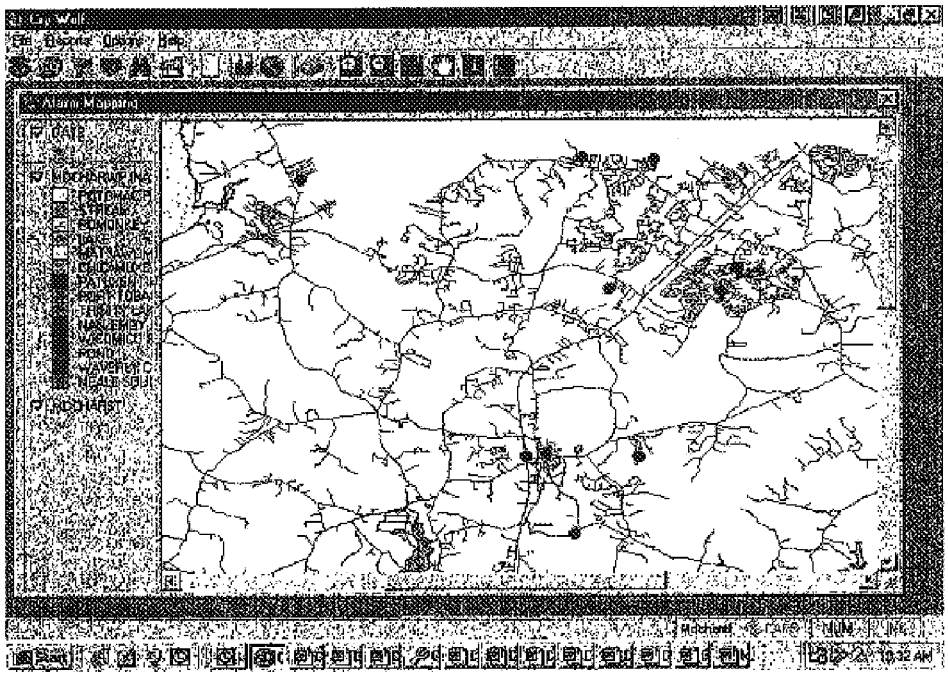
FIG. 15 is an additional screen capture of the Alarm Mapping component of the preferred embodiment of the present invention.

The preferred embodiment also provides the ability to geographically view alarm information as seen in FIGS. 13, 14, and 15. The preferred embodiment may use Map Objects, such as ESRI Map Objects, to incorporate the mapping functionality. Mapping is developed by creating unique layers of geographic information based on the User's requests. Each layer is placed on top of the default base layer of streets for the User's jurisdiction. Each layer is listed in a Legend shown to the left of the map. Only one layer is considered active at a time. To make any layer active just click once on the layer name in the Legend. The name of this layer will appear in the lower right-hand comer of the screen.

The User can edit, modify, and control the features they want to view, select the shape and color of the markers and name the layers. The User can choose to map all locations, or limit the map to specific Location Types such as only mapping Residential or Government locations. Most maps create a single layer showing all the alarms for a selected date range matching the criteria. Another feature includes the ability to automatically group matching records into separate layers, such as for each day of the week. As seen in FIGS. 14 and 15, the User can Zoom In or Zoom Out within the map. The User can also move the map around. The User can view information on a particular location by showing the address information for the point selected.

Figure 16:
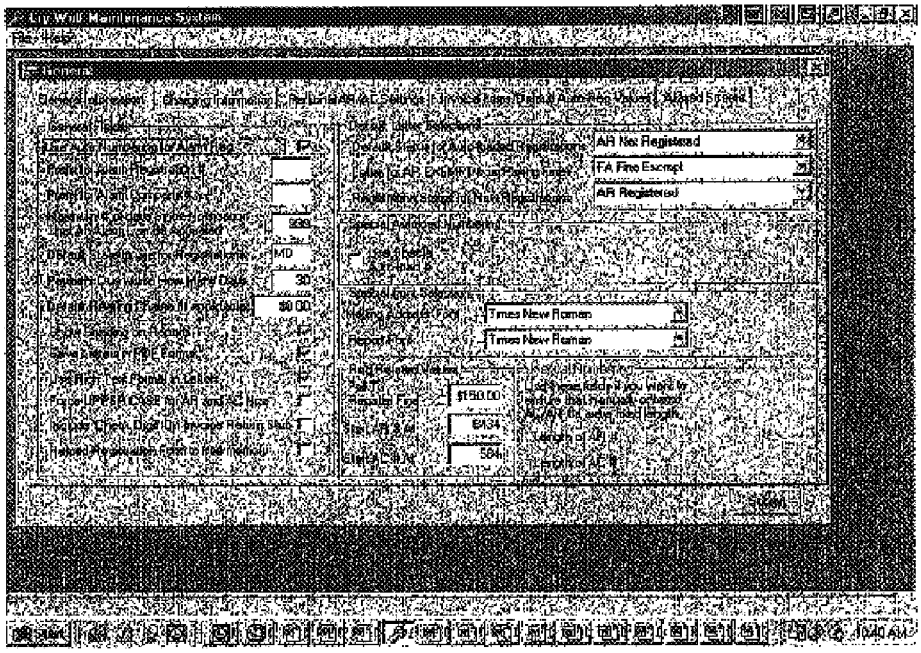
FIG. 16 is a screen capture of the General Information portion of the General Maintenance component of the preferred embodiment of the present invention.
Figure 17:
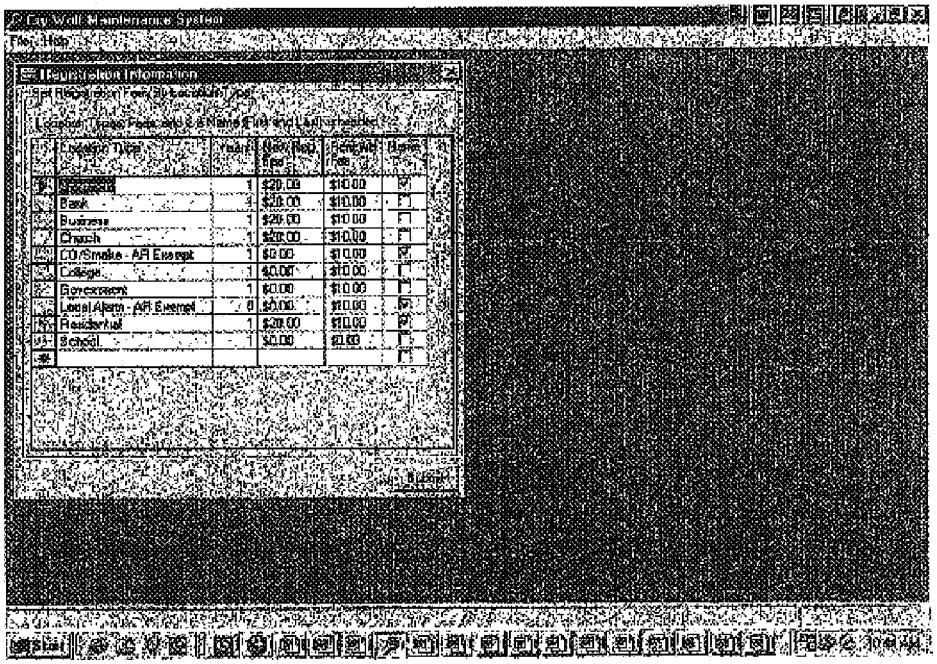
FIG. 17 is a screen capture of the Registration Information portion of the General Maintenance component of the preferred embodiment of the present invention.

The preferred embodiment also has a General Information section, as seen in FIGS. 16 and 17, which processes basic information required for the system. The General Information feature allows for automatic numbering, default state to use for Registrations, Payment Due Date allowance, Default Hearing Charge, Check boxes for Escrow Accounts, Shading capability on Reports, Saving Letters in PDF Format, Setting Alarm Fines, several default values and charging options.

The General Information feature includes a Registration Information portion, which allows the User to customize or add sub-categories of registrations and attach fees according to these categories. The system starts with two types, Residential and Business. But registration types are not limited to just Residential and Business. The User can customize the types of registrations allowed with each registration having its own fee. During the processing of alarms, the User has the option of automatically loading new alarm registrations into the database. The User can also associate a default alarm Company for every new registration. Under the Registration Information portion, the User may define an additional penalty fee to be applied when false alarms occur at unregistered locations.

The preferred embodiment also may include a strong security module where a system administrator has the ability to assign very specific rights to each user. For example, the system administrator may allow a person to enter registration information but not process alarm files. Or the system administrator may restrict who can generate reports or allow a person to generate reports, but not to print them.

While the invention has been described in detail and with reference to specific embodiments thereof, it will be apparent to those skilled in the art that various changes and modifications can be made therein without departing from the spirit and scope thereof. Thus, it is intended that the present invention cover the modifications and variations of this invention provided they come within the scope of the appended claims and their equivalents.

What is claimed is:

1. A method for tracking and processing false alarms comprising the steps of:

establishing a set of pre-defined criteria;

obtaining an alarm data file comprised of at least one alarm record, wherein said at least one alarm record contains a plurality of alarm data including an associated record identifier;

processing each one of said at least one alarm record against a plurality of stored alarm data;

combining data from said at least one alarm record to related data within said plurality of stored alarm data to create a combined alarm data record;

comparing said combined alarm data record against said set of predefined criteria to determine if any data of said combined alarm data record has met or exceeded at least one of said set of predefined criteria; and creating an appropriate correspondence for said record identifier associated with said at least one alarm data record which has exceeded at least one of said set of predefined criteria.

2. The method of claim 1, wherein said correspondence is an invoice.

3. The method of claim 1, wherein said record identifier is the name of the alarm registrant associated with said alarm record.

4. The method of claim 1, wherein said record identifier is the location of an alarmed facility associated with said alarm record.

5. The method of claim 1, further including the steps of determining if said alarm record is related to a new registrant and if so creating a new registrant entry within said plurality of stored alarm data.

6. The method of claim 1, further including the steps of determining if said alarm record is related to a new location and if so creating a new location entry within said plurality of stored alarm data.

7. A programmable software application for tracking and processing false alarms which performs the following processing steps:

establishes a set of pre-defined criteria;

obtains an alarm data file comprised of at least one alarm record, wherein said at least one alarm record contains a plurality of alarm data including an associated record identifier;

processes each one of said at least one alarm record against a plurality of stored alarm data;

combines data from said at least one alarm record to related data within said plurality of stored alarm data to create a combined alarm data record;

compares said combined alarm data record against said set of predefined criteria to determine if any data of said combined alarm data record has met or exceeded at least one of said set of predefined criteria; and creates an appropriate correspondence to send to said record identifier associated with said at least one alarm data record which has exceeded at least one of said set of predefined criteria.

8. The programmable software application of claim 7, wherein said correspondence is an invoice.

9. The programmable software application of claim 7, further including the processes of determining if said alarm record is related to a new registrant and if so creating a new registrant entry within said plurality of stored alarm data.

10. The programmable software application of claim 7, further including the processes of determining if said alarm record is related to a new location and if so creating a new location entry within said plurality of stored alarm data.

* * * * *